US005901614A

United States Patent [19]

Ewing

[11] Patent Number: 5,901,614

[45] Date of Patent: May 11, 1999

[54] ADJUSTABLE CLUTCH PEDAL SYSTEM

[75] Inventor: Kip Alan Ewing, Dearborn, Mich.

[73] Assignee: Ford Global Technologies, Inc., Dearborn, Mich.

[21] Appl. No.: 08/978,592

[22] Filed: Nov. 25, 1997

[51] Int. Cl.[6] ..... G05G 1/14

[52] U.S. Cl. ..... 74/512; 74/560; 74/542

[58] Field of Search ..... 74/512–514, 560, 74/516, 542, 518, 523, 528, 535, 538; 192/111 A

[56] References Cited

U.S. PATENT DOCUMENTS

| | | | |
|---|---|---|---|
| 2,071,658 | 2/1937 | Roberts | 188/204 |
| 2,190,972 | 2/1940 | Boldt | 74/516 |
| 3,039,322 | 6/1962 | Prowrie . | |
| 3,151,499 | 10/1964 | Roe . | |
| 3,242,763 | 3/1966 | Buchwald . | |
| 3,282,125 | 11/1966 | Dully . | |
| 3,400,607 | 9/1968 | Smith . | |
| 3,541,881 | 11/1970 | Pharis . | |
| 3,563,111 | 2/1971 | Zeigler . | |
| 3,691,868 | 9/1972 | Smith . | |
| 3,828,625 | 8/1974 | Bruhn | 74/512 |
| 3,975,972 | 8/1976 | Muhleck . | |
| 4,497,399 | 2/1985 | Kopich | 192/111 A |
| 4,875,385 | 10/1989 | Sitrin . | |
| 5,172,606 | 12/1992 | Dzioba et al. . | |
| 5,351,573 | 10/1994 | Cicotte . | |
| 5,588,335 | 12/1996 | Strait | 74/512 |
| 5,611,249 | 3/1997 | Perisho et al. | 74/512 |
| 5,855,143 | 1/1999 | Ewing | 74/512 |

FOREIGN PATENT DOCUMENTS

| | | | |
|---|---|---|---|
| 1217704 | 3/1986 | U.S.S.R. | 74/512 |

*Primary Examiner*—Vinh T. Luong
*Attorney, Agent, or Firm*—Gregory P. Brown

[57] ABSTRACT

An adjustable clutch pedal apparatus allows the adjustment of a first end of a pedal lever (18) to accommodate operators having varying anatomical characteristics. The apparatus includes a master cylinder (32) mounted on the pedal lever and an adjuster link (28) having a first end pivotally connected to a second end of the pedal lever and a first end pivotally connected to a first ground point (44). An anchor link (50) is pivotally connected to a second ground point at one end and a second point of a rocker (60) at the opposite end. A push rod (68) interconnects the rocker to the master cylinder, thereby allowing actuation of the cylinder upon displacement of the pedal and master cylinder assembly. The interconnection of the adjuster link, the pedal lever and a second point (62) on the rocker form a virtual ground point (72) allowing the first end of the pedal lever (18) to be adjusted between first and second pedal positions.

8 Claims, 3 Drawing Sheets

ADJUSTABLE CLUTCH PEDAL SYSTEM

BACKGROUND OF THE INVENTION

1. Field of the Invention

The present invention relates generally to control devices for motor vehicles. More particularly the apparatus is useful for providing an adjustable clutch pedal position to accommodate various vehicle operators.

2. Disclosure Information

In the conventional motor vehicle, pedals are provided for controlling the brakes and engine throttle. If the vehicle has a manual transmission, then a clutch pedal may also be provided. These pedal controls are operated by the vehicle operator. In order for the vehicle operator to obtain the most advantageous position for working these controls, the vehicle's front seat is usually slidably mounted on a seat track with means for retaining the seat along the track in a number of set positions.

The adjustment provided by moving the seat along the seat track does not accommodate all vehicle operators due to obvious differences in anatomical dimensions. It has therefore been recognized that it would be desirable to provide pedals that are adjustable so as to increase the comfort of the vehicle operator. For instance, U.S. Pat. No. 3,400,607, assigned to the same Assignee as the present invention, provides a vehicle control assembly for providing pedal adjustments. Previous adjustable pedal assemblies shared common shortcomings preventing their wide commercial success. Generally the designs were costly, very complex to manufacture and assemble and inconsistent in function throughout their range of adjustment. Specifically, the function attributes include providing a constant motion ratio through the full range of pedal adjustment, which is desirable for maintaining the desired actuation efforts. Additionally, previous adjustable pedal assemblies did not provide consistent ergonomic pedal travel throughout the range of adjustment.

It would be desirable to overcome the aforenoted difficulties with previous adjustable pedal assemblies for use in motor vehicles by providing a simple, low cost apparatus for adjusting the pedal location and providing all operators of various anatomical dimensions preferred pedal efforts and ergonomic pedal travel for operation of the motor vehicle.

SUMMARY OF THE INVENTION

Therefore, the present invention provides an improvement over conventional vehicles by providing an adjustable clutch pedal control that is moveably mounted so that the operator may select an appropriate spacing between the seat and the pedals commensurate with the length of the operators legs.

In accordance with the present invention, an adjustable clutch pedal apparatus for actuating a clutch within a vehicle includes a pedal lever having a first end and an adjuster link having a first end pivotally connected to a second end of the pedal lever. A second end of the adjuster link is pivotally connected to a first ground point. An anchor link is provided having a first end pivotally connected to a second ground point. The pedal assembly also includes a rocker having a first point pivotally connected to a second end of the anchor link and a second point pivotally connected to the first end of the adjuster link and the second end of the pedal lever.

A master cylinder is fastened to the pedal lever between the first end and the second end of the pedal lever for actuation by a push rod having a first end pivotally attached to a third point on the rocker and a second end connected to the master cylinder.

Together, the first end of the adjuster link and the second end of the pedal lever and the second point of the rocker form a virtual ground point. Adjustment of the adjuster link relative to the first ground point between a first position and a second position adjusts the first end of the pedal lever between corresponding first and second pedal positions.

It is an advantage of the present invention to provide a simple, low cost adjustable clutch pedal apparatus capable of providing, throughout its range of adjustment, consistent pedal efforts and ergonomic pedal travel for operation of the motor vehicle.

DETAILED DESCRIPTION OF THE PREFERRED EMBODIMENT

Figure 1:
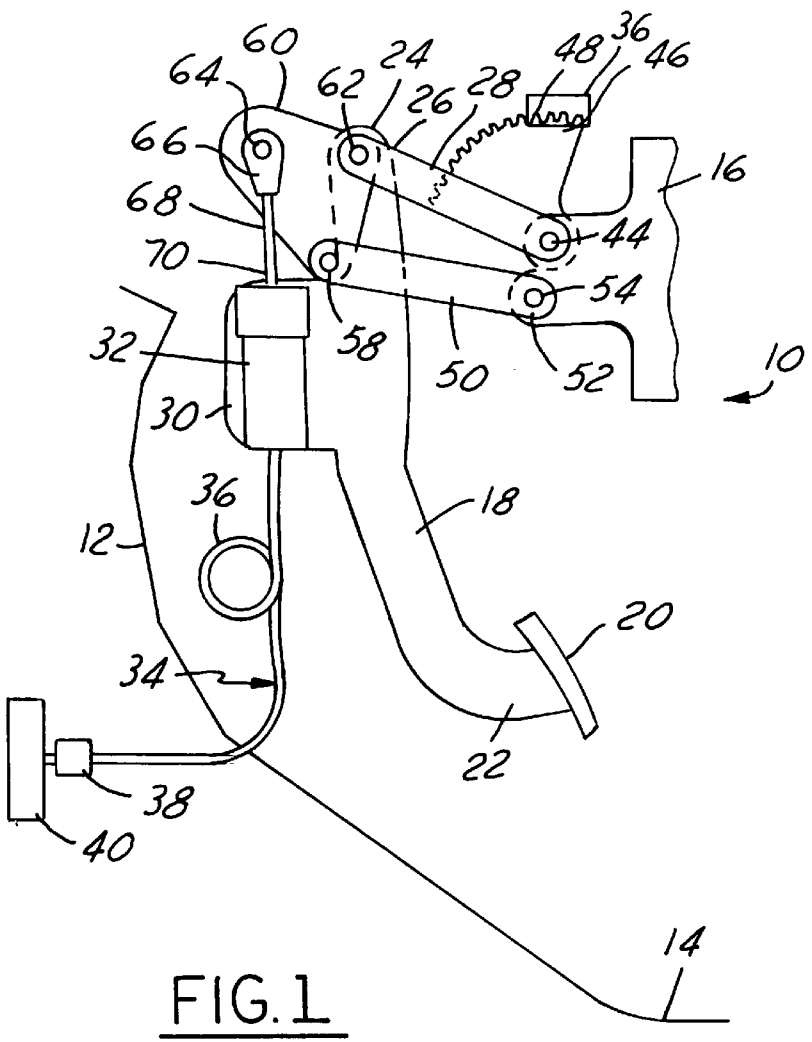
FIG. 1 is a side elevational view of an adjustable pedal mechanism for a motor vehicle constructed in accordance with the present invention.

Referring now to FIG. 1, the adjustable clutch pedal assembly 10 is shown installed in a motor vehicle. The vehicle includes a dash panel 12, which extends downward to a portion of a floor member 14, and a pedal support structure 16, which may be constructed from crossbars integrated with an instrument panel and steering column support structure.

A pedal lever 18 includes a pad 20 at its first end 22 and a second end 24 that is pivotally connected a first end 26 of an adjuster link 28. The pedal lever also includes a flange 30 formed integrally from the pedal lever 18 between the first and second ends 22, 24 of the pedal lever 18. A master cylinder 32 is securely fastened to flange 30. A hydraulic conduit 34, including a flexible portion 36, hydraulically interconnects the master cylinder 32 to a slave cylinder 38 for actuating a clutch mechanism 40.

A second end 42 of the adjuster link 28 is pivotally connected to a first ground point 44 which depends from the stationary pedal support structure 16. An adjuster mechanism, illustrated here by a sector gear 46, drivingly engaged with an electric motor driven worm gear 48, provides for infinitely adjusting the position of the adjuster link 28 relative to the first ground point 44 between two positions defined by the ends of the sector gear. In the illustrated embodiment, the gear ratio of the sector gear and the worm gear are sufficient to prevent unintended movement of the sector gear during operation of the pedal. It should be recognized by those skilled in the art that the adjuster mechanism may comprise one of many known devices, including driving the worm gear via a remote motor and cable, or with a manual mechanism providing the displacement of a cable through actuation of a lever or knob.

An anchor link 50 includes a first end 52 pivotally connected to a second ground point 54 which depends from the stationary pedal support structure 16. A second end 56 of the anchor link 50 is pivotally connected to a first point 58 of a rocker 60. A second point 62 of the rocker 60 is coterminous with and pivotally connected to the first end 26 of the adjuster link 28 and the second end 24 of the pedal lever 18. A third point 64 of the rocker 60 is pivotally connected to a first end 66 of a push rod 68, which also includes a second end 70 attached to the master cylinder 32.

For any adjusted position of the adjuster link 28, a unique virtual ground point 72 is formed by the connection of the first end of the adjuster link, the second end of the pedal lever and the second point 62 of the rocker 60. Adjustment of the adjuster link 28 relative to the first ground point 44 between a first position and a second position adjusts the location of the virtual ground point 72 and adjusts the location of the first end of the pedal lever between corresponding first and second positions.

Operation of the adjustable clutch pedal will now be described. FIG. 1 illustrates the pedal assembly in an released position, that is, with no input force being applied by an operator. Further, the pedal is adjusted to its first or forward most position, to accommodate operators having longer legs, thus requiring greater space between a seat and the pedal assembly. The pedals may also be put in this position to facilitate ingress and egress of the operator.

Figure 2:
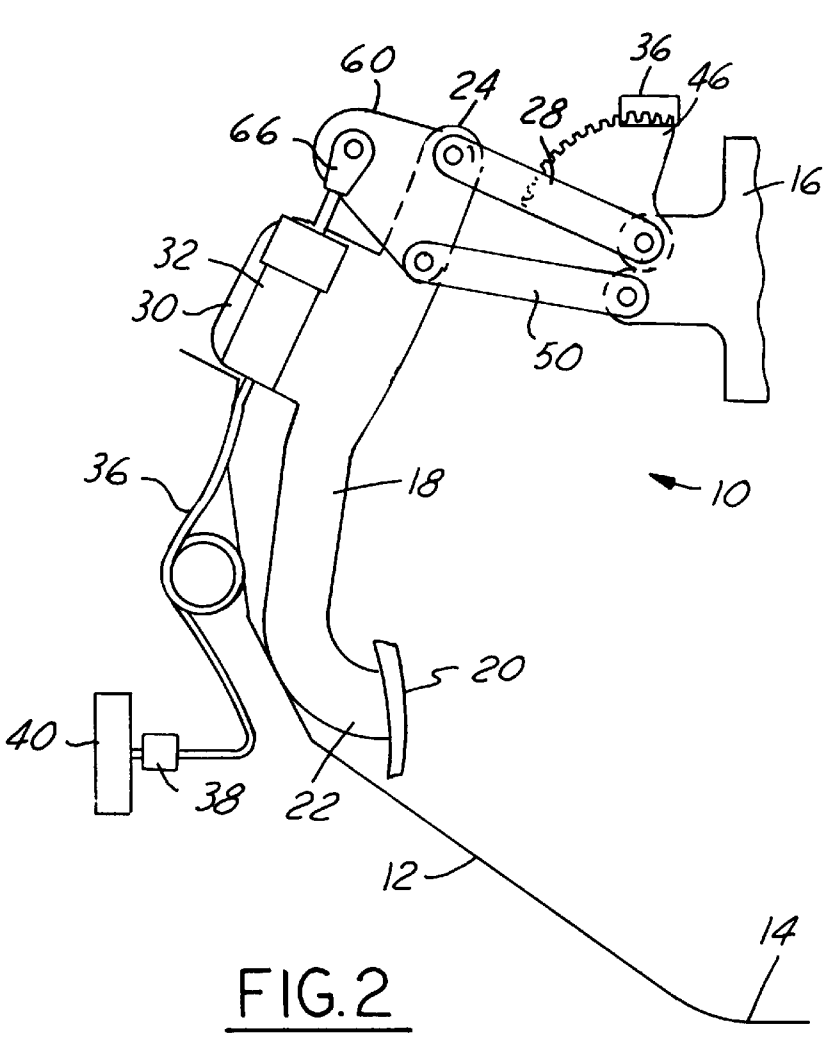
FIG. 2 is a side elevational view of an adjustable pedal mechanism for a motor vehicle constructed in accordance with the present invention.

FIG. 2 illustrates the pedal subjected to an input force and having been full displaced. The adjuster link 28, the virtual ground point 72 do not move during operation of the pedal. As the pedal is pressed toward the floor by the operator, the pedal lever 18 pivots about the virtual ground point 72. The master cylinder 32, being attached to the pedal 18, also rotates about the virtual ground point 72. The rocker 60 is prevented from rotating by the virtual ground point 72 and the anchor link 50. Therefore, an output displacement and force results from the master cylinder being forced onto the push rod 68, thus disengaging the clutch 40.

Figure 5:
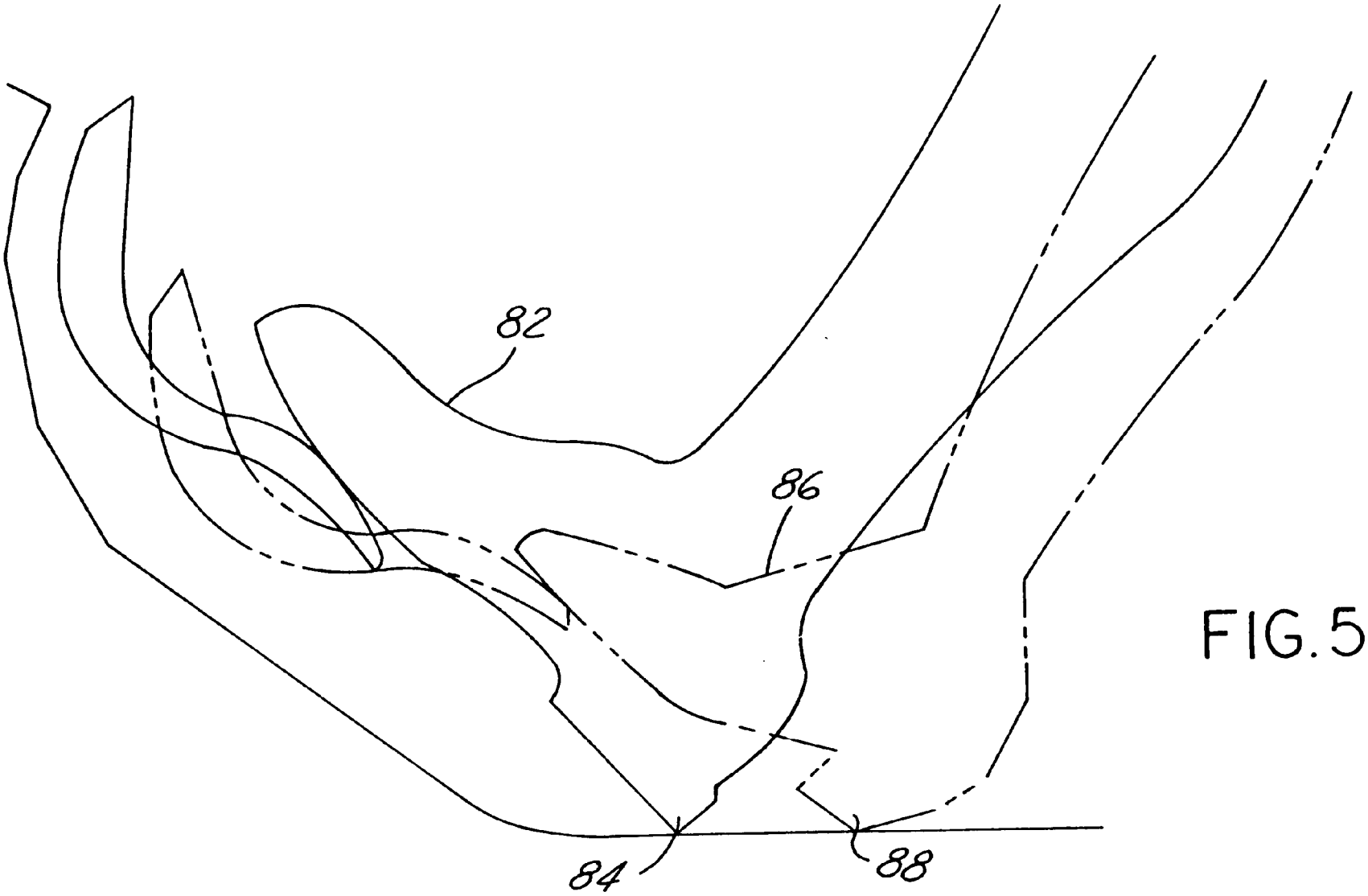
FIG. 5 is a side elevational view showing a ninety-fifth percentile operator's foot relative to a correspondingly adjusted pedal and a two and a half percentile operator's foot relative to a correspondingly adjusted pedal as provided by the by the present invention.

Referring now to FIG. 5, operation of the pedal lever 18 from the adjusted position just described is represented by the large foot outline 82. It can be seen that the heel 84 of the operator's foot rests on a portion of the floor member 14. It is well known that to prevent fatigue and discomfort, it is important to allow the operator's heel 84 to rest on the floor member 14 while maintaining contact with the pad 20 of the brake lever. Additionally, the operator should be able to press the pedal through its travel without lifting the heel from the floor member.

Referring now to the smaller foot 86, it should be apparent that for this operator to apply the pedal with it in the forward most position (shown as A) the operator would either have to lift the small heel 88 from the floor, or move the seat considerably forward. Moving the seat forward is undesirable for a variety of reasons, including the sharper angles that the operators leg and foot must form to operate the pedal. For these reasons and others, the present invention permits the operator to adjust the pedal lever rearward in such a manner that an operator with shorter legs can maintain heel contact while pressing the pedal lever through its range of motion.

Figure 4:
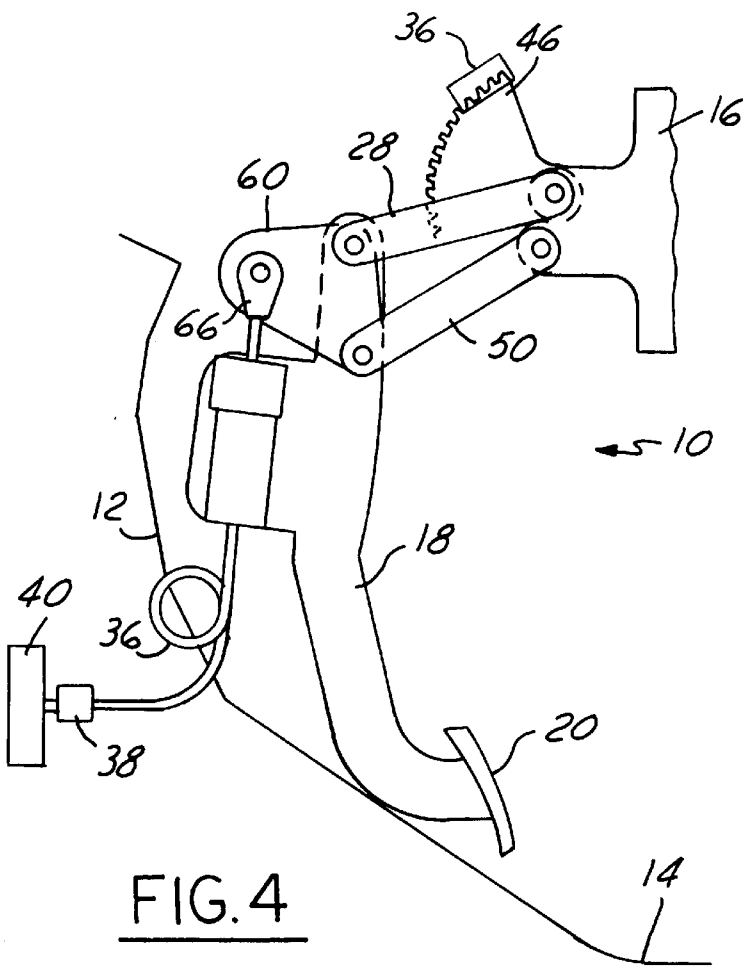
FIG. 4 is a side elevational view of an adjustable pedal mechanism for a motor vehicle constructed in accordance with the present invention.
Figure 3:
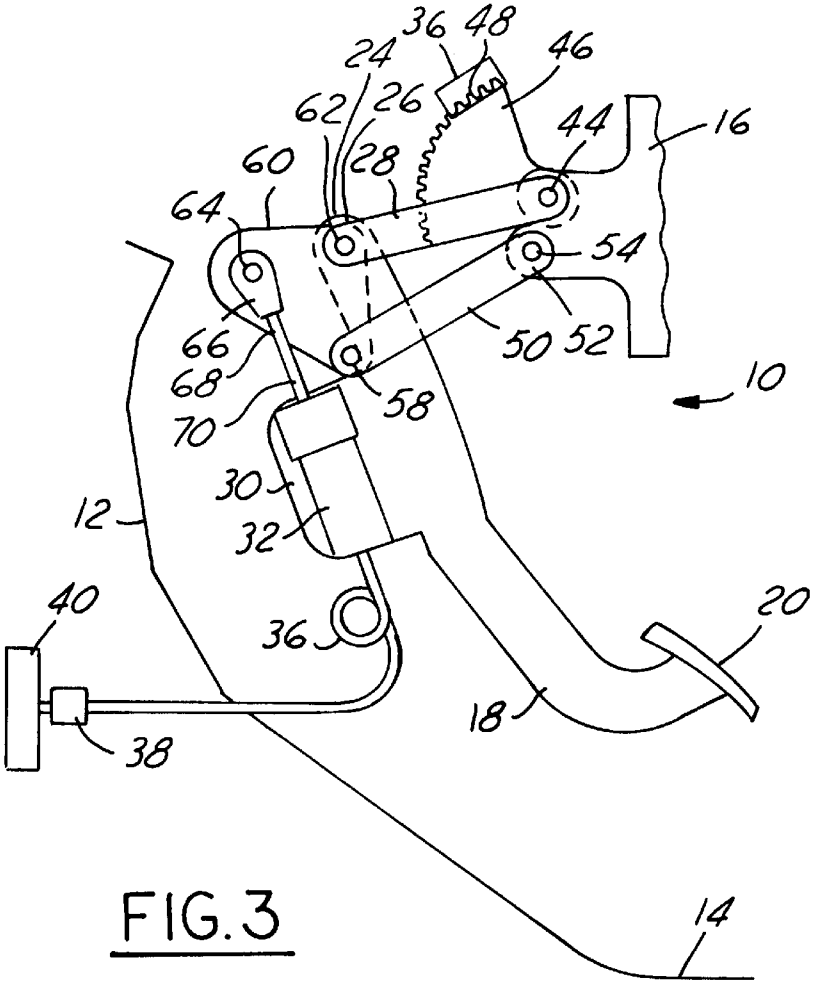
FIG. 3 is a side elevational view of an adjustable pedal mechanism for a motor vehicle constructed in accordance with the present invention.

FIGS. 3 and 4 illustrate the adjustable pedal assembly adjusted to its second or rearward position in the released and applied positions, respectively. The adjustment is accomplished by manipulating the sector gear 46 so as to rotate the adjuster link 28 downward about the first ground point 44. This drives the virtual ground point 72 downward, which repositions the rocker 60. From this it can be seen that the distances between the three points on the rocker 60 must be chosen carefully to provide as nearly consistent motion ratios for all adjusted positions of the adjuster link 28 as possible. This is important to provide effort and displacement characteristics that are not noticeably different to operators for the actuation of the clutch.

Various modifications and variations will no doubt occur to those skilled in the art to which this invention pertains. Those and all other variations which basically rely on the teachings by which this disclosure has advanced the art are properly considered within the scope of this invention as defined by the appended claims.

I claim:

1. An adjustable clutch pedal apparatus for actuating a clutch within a vehicle, said adjustable pedal apparatus comprising:

a pedal lever having a first end;

an adjuster link having a first end pivotally connected to a second end of said pedal lever and a second end pivotally connected to a first ground point;

an anchor link having a first end pivotally connected to a second ground point;

a rocker having a first point pivotally connected to a second end of said anchor link and a second point pivotally connected to said first end of said adjuster link and said second end of said pedal lever;

a master cylinder fastened to said pedal lever between said first end and said second end of said pedal lever; and a push rod having a first end pivotally attached to a third point on said rocker and a second end connected to said master cylinder;

wherein said first end of said adjuster link and said second end of said pedal lever and said second point of said rocker form a virtual ground point, such that adjustment of said adjuster link relative to said first ground point between a first position and a second position adjusts said first end of said pedal lever between corresponding first and second pedal positions.

2. An adjustable clutch pedal apparatus according to claim 1, further comprising a flexible hydraulic line interconnecting said master cylinder to a slave cylinder operatively associated with the clutch.

3. An adjustable clutch pedal apparatus according to claim 1, further comprising adjuster means connected to said adjuster link for rotating said adjuster link relative to said first ground point between said first position and said second position and thereafter preventing further rotation of said adjuster link.

4. An adjustable clutch pedal apparatus according to claim 3, wherein said adjuster means comprises a sector gear attached to said adjuster link adjacent to said first end of said adjuster link and a worm gear for meshingly engaging said sector gear.

5. An adjustable clutch pedal apparatus for actuating a clutch within a vehicle, said adjustable pedal apparatus comprising:

a pedal lever having a pad disposed on a first end;

an adjuster link having a first end pivotally connected to a second end of said pedal lever and a second end pivotally connected to a first ground point;

adjuster means for rotating said adjuster link relative to said first ground point between a first position and a second position;

an anchor link having a first end pivotally connected to a second ground point;

a rocker having a first point pivotally connected to a second end of said anchor link and a second point coterminous with and pivotally connected to said first end of said adjuster link and said second end of said pedal lever;

a master cylinder fastened to said pedal lever between said first end and said second end of said pedal lever; and a push rod having a first end pivotally attached to a third point on said rocker and a second end connected to said master cylinder such that said push rod applies an output displacement and force to said master cylinder in response to an input displacement and force applied to said first end of said pedal lever;

wherein said first end of said adjuster link and said second end of said pedal lever and said second point of said rocker form a virtual ground point, such that adjustment of said adjuster link relative to said first ground point between said first position and said second position adjusts said first end of said pedal lever between corresponding first and second pedal positions.

6. An adjustable clutch pedal apparatus according to claim 5, wherein said adjuster means comprises a sector gear attached to said adjuster link adjacent to said first end of said adjuster link and a worm gear for meshingly engaging said sector gear.

7. An adjustable clutch pedal apparatus according to claim 5, further comprising a flexible hydraulic line interconnecting said master cylinder to a slave cylinder operatively associated with the clutch.

8. An adjustable clutch pedal apparatus for actuating a clutch within a vehicle, said adjustable pedal apparatus comprising:

a pedal lever having a pad disposed on a first end;

an adjuster link having a first end pivotally connected to a second end of said pedal lever and a second end pivotally connected to a first ground point;

adjuster means for rotating said adjuster link relative to said first ground point between a first position and a second position;

an anchor link having a first end pivotally connected to a second ground point;

a rocker having a first point pivotally connected to a second end of said anchor link and a second point coterminous with and pivotally connected to said first end of said adjuster link and said second end of said pedal lever;

a master cylinder fastened to said pedal lever between said first end and said second end of said pedal lever;

a slave cylinder operatively associated with the clutch;

a hydraulic conduit interconnecting said master cylinder and said slave cylinder for fluid communication therebetween, said conduit having a flexible portion thereof to allow articulation of said master cylinder with said pedal lever; and a push rod having a first end pivotally attached to a third point on said rocker and a second end connected to said master cylinder such that said push rod applies an output displacement and force to said master cylinder in response to an input displacement and force applied to said first end of said pedal lever.

* * * * *